US005611540A

United States Patent [19]

Williams et al.

[11] Patent Number: 5,611,540

[45] Date of Patent: Mar. 18, 1997

[54] TETHERED BALL APPARATUS

[76] Inventors: Sean P. Williams; James J. Williams, both of 15775 Hocking Blvd., Brookpark, Ohio 44142

[21] Appl. No.: 599,166

[22] Filed: Feb. 9, 1996

[51] Int. Cl.[6] ..... A63B 43/00

[52] U.S. Cl. ..... 473/429; 473/573; 473/575

[58] Field of Search ..... 273/413, 414, 273/55 B, 58 C, 65 R

[56] References Cited

U.S. PATENT DOCUMENTS

| | | | |
|---|---|---|---|
| D. 340,267 | 10/1993 | Robles | D21/62 |
| 4,147,353 | 4/1979 | Moore | 273/413 |
| 4,270,757 | 6/1981 | Ligon | 273/413 X |
| 4,311,312 | 1/1982 | O'Brien | 273/195 A |
| 4,324,220 | 4/1982 | Joelson | 124/18 |
| 4,350,338 | 9/1982 | May | 273/55 B |
| 5,108,107 | 4/1992 | Shelton et al. | 273/200 R |
| 5,181,726 | 1/1993 | Piaget | 273/58 C X |
| 5,209,489 | 5/1993 | Dorny et al. | 273/321 |

FOREIGN PATENT DOCUMENTS

| | | | |
|---|---|---|---|
| 655781 | 1/1963 | Canada | 273/58 C |

*Primary Examiner*—William H. Grieb

[57] ABSTRACT

A tethered ball apparatus includes an attachment assembly for attachment to a rigid support. A swivel assembly is connected to the attachment assembly, and an elastic cord is connected to the swivel assembly. A cord receiver includes an externally threaded screw portion, and the elastic cord is connected to the cord receiver. A ball assembly includes an internally threaded anchor embedded in a portion of the ball assembly, and the externally threaded screw portion of the cord receiver is screwed into the internally threaded anchor. In one embodiment, the attachment assembly includes a support-attaching screw eye. In another embodiment, the attachment assembly includes a strap assembly which contains a quantity of a hook-containing fabric and a quantity of a complementary loop-containing fabric. The swivel assembly includes a swiveling strap eye bolt snap. The elastic cord is comprised of bungee cord material. The cord receiver includes a ball-attaching screw eye. The internally threaded anchor in the ball assembly is comprised of an internally threaded hollow cylindrical anchor which further includes external threads. The ball assembly may be a football which has two pointed ends, and the internally threaded anchor is located in the football at one of the pointed ends. With a football, the ball assembly includes an exterior jacket portion, and an inflated internal tube portion. The internally threaded anchor is secured into a pointed end of the exterior jacket portion of the ball assembly.

1 Claim, 3 Drawing Sheets

FIG 1
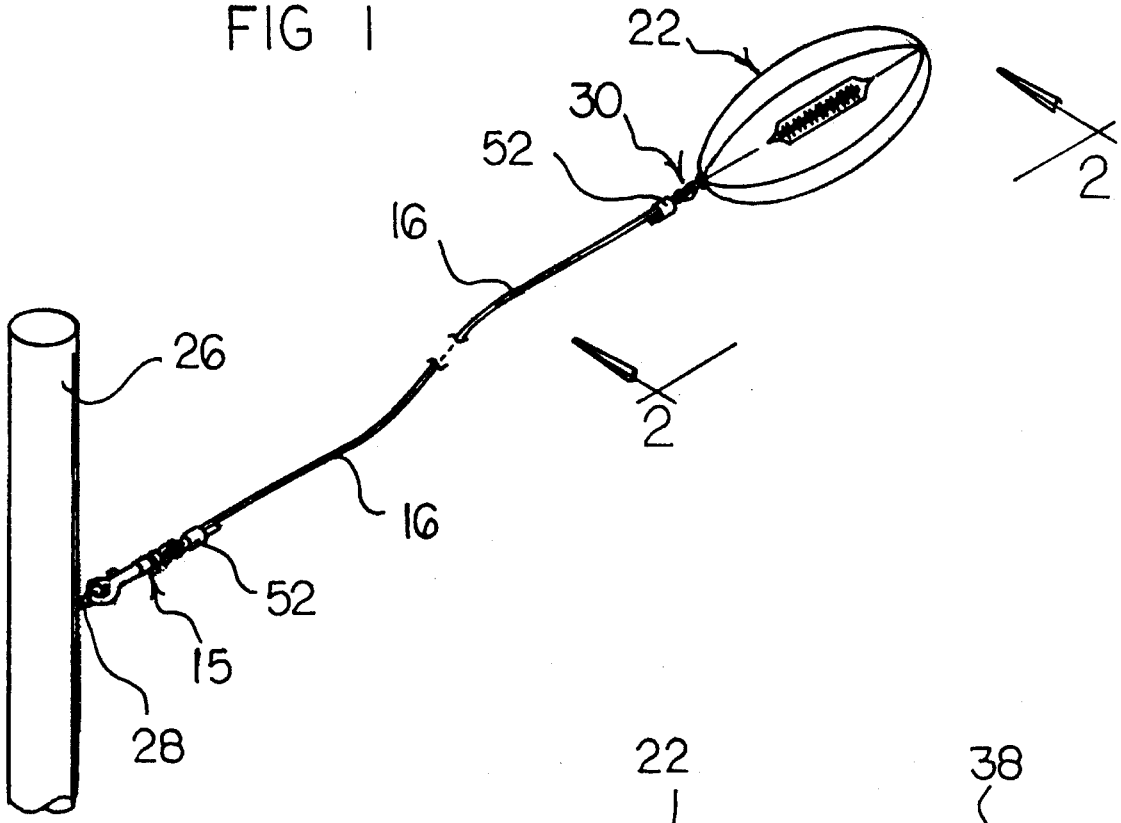
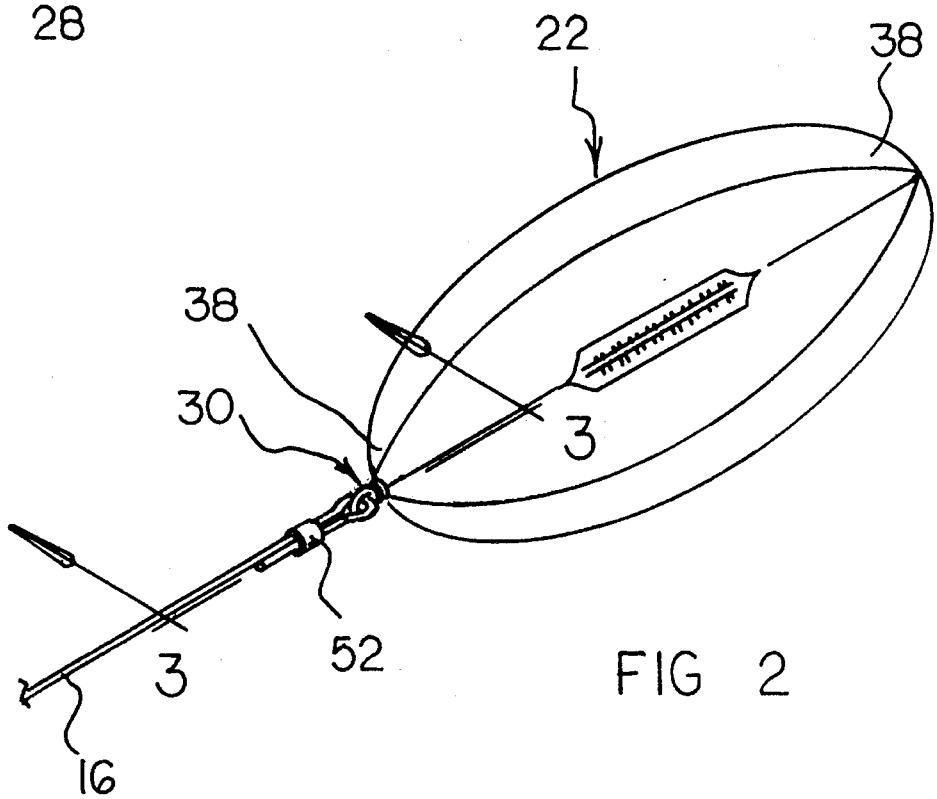
FIG 2

FIG 5
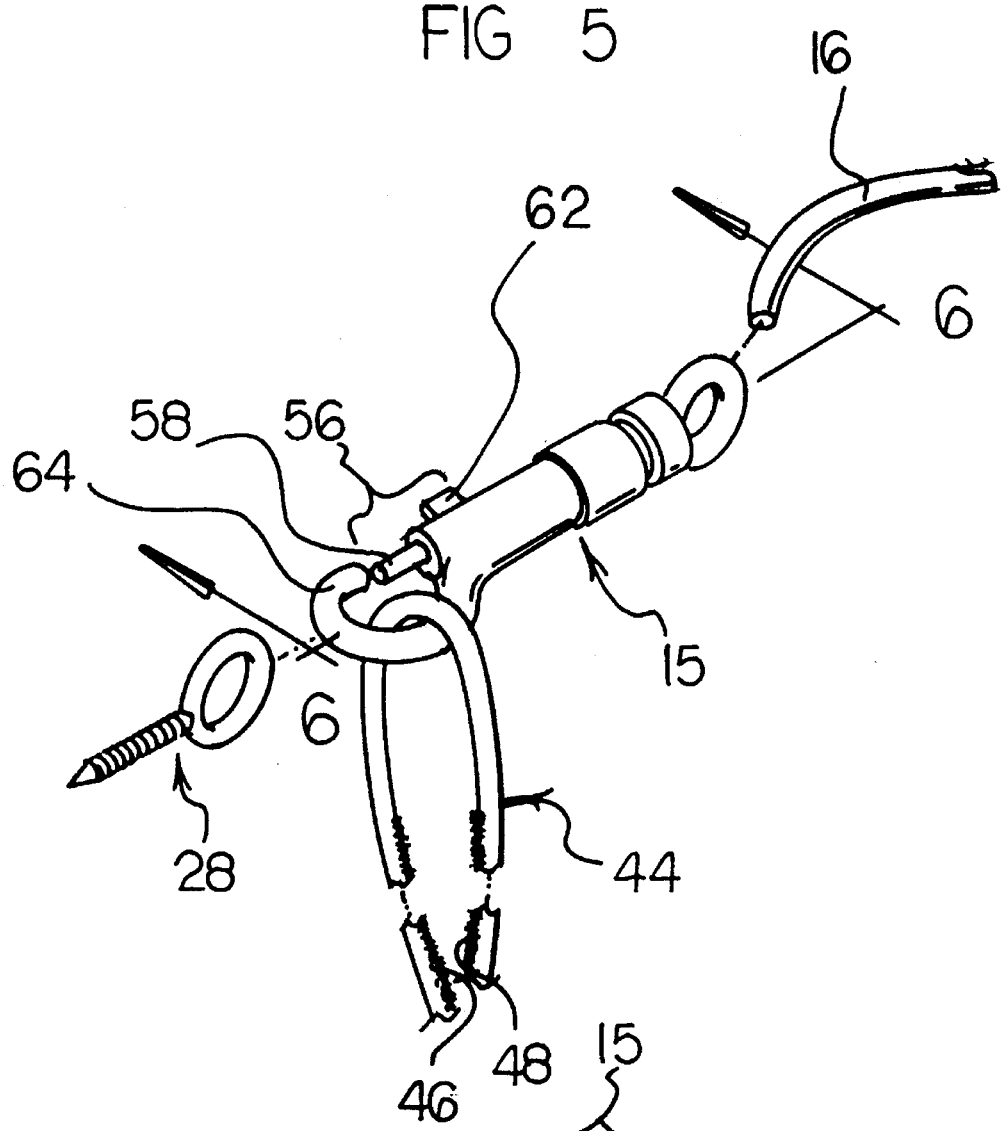
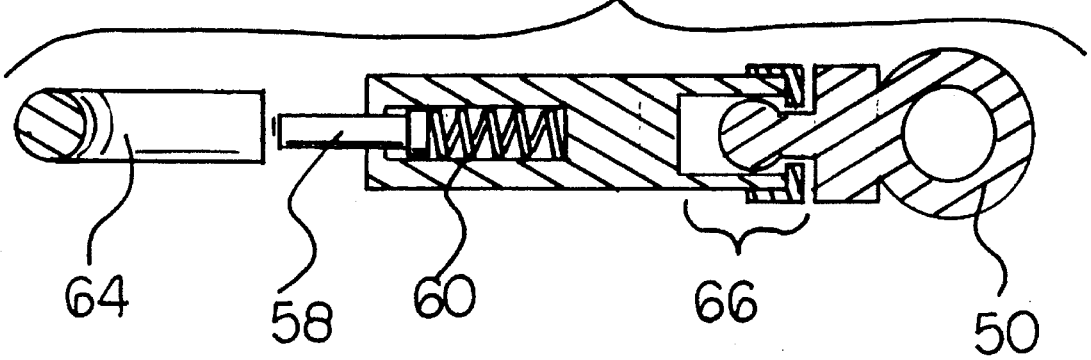
FIG 6

TETHERED BALL APPARATUS

BACKGROUND OF THE INVENTION

1. Field of the Invention

The present invention relates generally to devices for practicing sporting skills and, more particularly, to devices employing tethered balls.

2. Description of the Prior Art

In many sports, in order to gain proficiency in the sport, practicing skills associated with the sport is often desirable. In sports where two or more players are involved, it is often difficult to gather two or more players for a practice session. In sports which include balls, one solution to this problem is the development of the tethered ball. When a person uses a tethered ball, the person can practice a sports skill in a solitary manner. In this respect, throughout the years, a number of innovations have been developed relating to tethered balls, and the following U.S. Pat. Nos. are representative of some of those innovations: 4,324,220, 4,350,338, 5,108,107, 5,209,489, and Des. 340,267. More specifically, U.S. Pat. No. 4,324,220 discloses a tethered slingshot-like toy in which an elastic cord passes through the interior of a tethered ball along a diameter from one end of the ball to the other in order to attach the elastic cord to the ball. The ball used with this toy is not inflatable. The means used for attaching the tether to the ball in this device could not be used with an inflatable ball. In this respect, it would be desirable if a ball were attached to a tether in such a way that an inflatable ball can be used with the tether.

U.S. Pat. No. 4,350,338 discloses a football practice aid which employs a football on a non-elastic tether which is attached to an elastic support. The football is connected to the tether by using a harness that has threads that fit into the recesses of the football. The harness can easily slip out of the recesses in the football during vigorous use. Although the elasticity in the elastic support is better than no elastic members at all, it would be desirable, for more elasticity, if the tether itself were elastic. In this respect, it would be desirable if a tethered ball employed an elastic tether. Furthermore, it would be desirable if a tethered ball had a means for attaching a ball to a tether without using a harness that has portions that fit into recesses of the ball.

U.S. Pat. No. 5,108,107 discloses a golf ball on a tether. The golf ball has a protuberance that projects outward from the spherical surface of the ball. The tether is attached to the protuberance. Therefore, because of the presence of the protuberance, when the tether is detached from the golf ball, the exterior surface of the golf ball will not permit the untethered ball to be used in a conventional manner. In contrast, however, it would be desirable if a tethered ball did not have a protuberance protruding from its surface when a tether is detached from the ball. This would permit the untethered ball to be used in a conventional manner.

U.S. Pat. No. 5,209,489 discloses a tethered ball which has the tether permanently connected to the ball. Clearly, this arrangement prevents the ball from being used in an untethered manner if desired. In this respect, it would be desirable if a tethered ball were not permanently connected to its tether. In addition, U.S. Pat. No. Des. 340,267 appears to disclose another tethered ball that is permanently connected to its tether. U.S. Pat. No. 4,311,312 may be of interest for its disclosure of retractable golf practice pad.

Still other features would be desirable in a tethered ball device. For example, it would be desirable if a tethered ball device included a swivel located between an elastic tether and a rigid support so that the tether will not become twisted during use of the ball. Moreover, it would be desirable if a tether were provided with an attachment means that is readily connected to and readily disconnected from a rigid support. This would permit the tethered ball device to be readily portable and carried to a variety of locations to which the tether could be attached.

Thus, while the foregoing body of prior art indicates it to be well known to use tethered ball devices, the prior art described above does not teach or suggest a tethered ball apparatus which has the following combination of desirable features: (1) provides a ball attached to a tether in such a way that an inflatable ball can be used with the tether; (2) employs an elastic tether; (3) has a means for attaching a ball to a tether without using a ball harness that has portions that fit into recesses of the ball; (4) does not have a protuberance protruding from the surface of a ball when a tether is detached from the ball; (5) provides a tethered ball that is not permanently connected to its tether; (6) includes a swivel located between an elastic tether and a rigid support; (7) provides an attachment means that is readily connected to and readily disconnected from a rigid support; and (8) is readily portable and is readily carried to a variety of locations to which the tether can be attached. The foregoing desired characteristics are provided by the unique tethered ball apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a tethered ball apparatus which includes an attachment assembly for attaching the tethered ball apparatus to a rigid support. A swivel assembly is connected to the attachment assembly, and an elastic cord is connected to the swivel assembly. A cord receiver includes an externally threaded screw portion, and the elastic cord is connected to the cord receiver. A ball assembly includes an internally threaded anchor embedded in a portion of the ball assembly, and the externally threaded screw portion of the cord receiver is screwed into the internally threaded anchor.

In accordance with one embodiment of the invention, the attachment assembly includes a support-attaching screw eye. The swivel assembly includes a swiveling strap eye bolt snap. The elastic cord is comprised of bungee cord material.

The cord receiver includes a ball-attaching screw eye. The ball-attaching screw eye includes an eye portion. An intermediate locking flange is located adjacent to the eye portion, and a screw portion projects from the intermediate locking flange. The internally threaded anchor in the ball assembly is comprised of an internally threaded hollow cylindrical anchor. The internally threaded hollow cylindrical anchor further includes external threads.

The ball assembly may include a football which has two pointed ends. With a football, the internally threaded anchor is located in the football at one of the pointed ends. With a football, the ball assembly includes an exterior jacket portion, and an inflated internal tube portion. The internally threaded anchor is secured into a pointed end of the exterior jacket portion of the ball assembly. The internally threaded hollow cylindrical anchor includes an exterior locking flange.

In accordance with another aspect of the invention, the attachment assembly includes a strap assembly which contains a quantity of a hook-containing fabric and a quantity of a complementary loop-containing fabric.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved tethered ball apparatus which has all of the advantages of the prior art and none of the disadvantages.

It is another object of the present invention to provide a new and improved tethered ball apparatus which may be easily and efficiently manufactured and marketed.

It is a further object of the present invention to provide a new and improved tethered ball apparatus which is of durable and reliable construction.

An even further object of the present invention is to provide a new and improved tethered ball apparatus which is susceptible of a low cost of manufacture with regard to both materials and labor, and which accordingly is then susceptible of low prices of sale to the consuming public, thereby making such tethered ball apparatus available to the buying public.

Still yet a further object of the present invention is to provide a new and improved tethered ball apparatus which provides a ball attached to a tether in such a way that an inflatable ball can be used with the tether.

Still another object of the present invention is to provide a new and improved tethered ball apparatus that employs an elastic tether.

Yet another object of the present invention is to provide a new and improved tethered ball apparatus which has a means for attaching a ball to a tether without using a ball harness that has portions that fit into recesses of the ball.

Even another object of the present invention is to provide a new and improved tethered ball apparatus that does not have a protuberance protruding from the surface of a ball when a tether is detached from the ball.

Still a further object of the present invention is to provide a new and improved tethered ball apparatus which provides a tethered ball that is not permanently connected to its tether.

Yet another object of the present invention is to provide a new and improved tethered ball apparatus that includes a swivel located between an elastic tether and a rigid support.

Still another object of the present invention is to provide a new and improved tethered ball apparatus which provides an attachment means that is readily connected to and readily disconnected from a rigid support.

Yet another object of the present invention is to provide a new and improved tethered ball apparatus that is readily portable and is readily carried to a variety of locations to which the tether can be attached.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a perspective view showing a first embodiment of the tethered ball apparatus of the invention attached to a rigid support using a rigid connector.

FIG. 2 is an enlarged perspective view of the portion of the embodiment of the invention in FIG. 1 taken along line 2—2 thereof.

FIG. 5 is a partial perspective view of a second embodiment of the invention showing a flexible connector for connecting the tether to a support.

FIG. 6 is an enlarged cross-sectional view of the swivel portion of the embodiment of the invention shown in FIG. 5 taken along line 6—6 thereof with the strap assembly removed.

DESCRIPTION OF THE PREFERRED EMBODIMENT

With reference to the drawings, a new and improved tethered ball apparatus embodying the principles and concepts of the present invention will be described.

Figure 3:
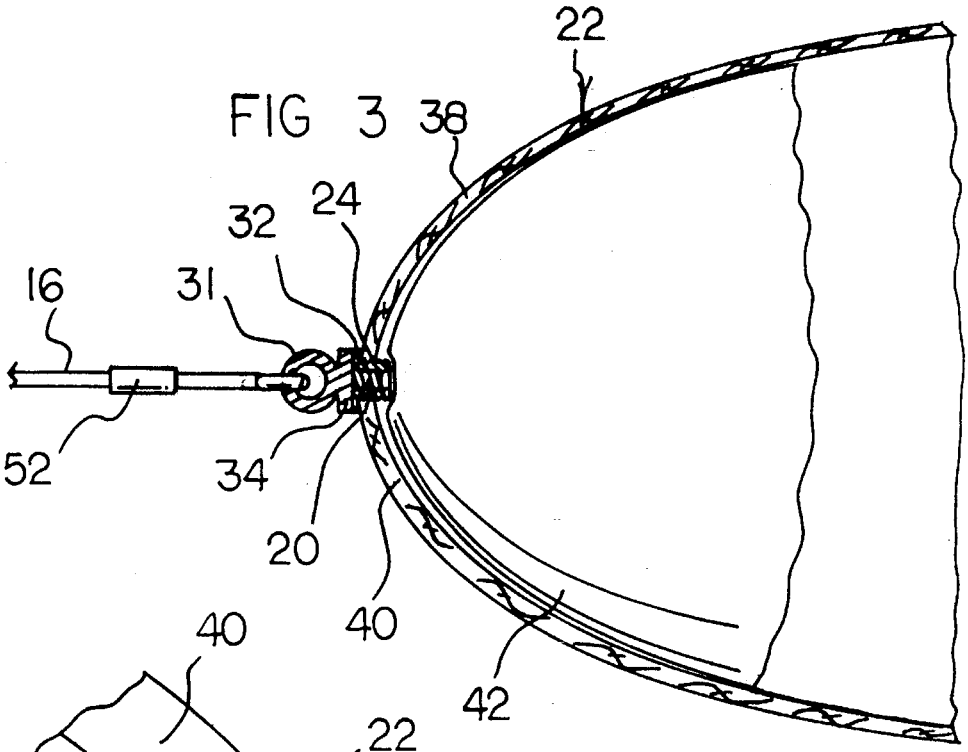
FIG. 3 is an enlarged cross-sectional view of the embodiment of invention of FIG. 2 taken along line 3—3 thereof.
Figure 4:
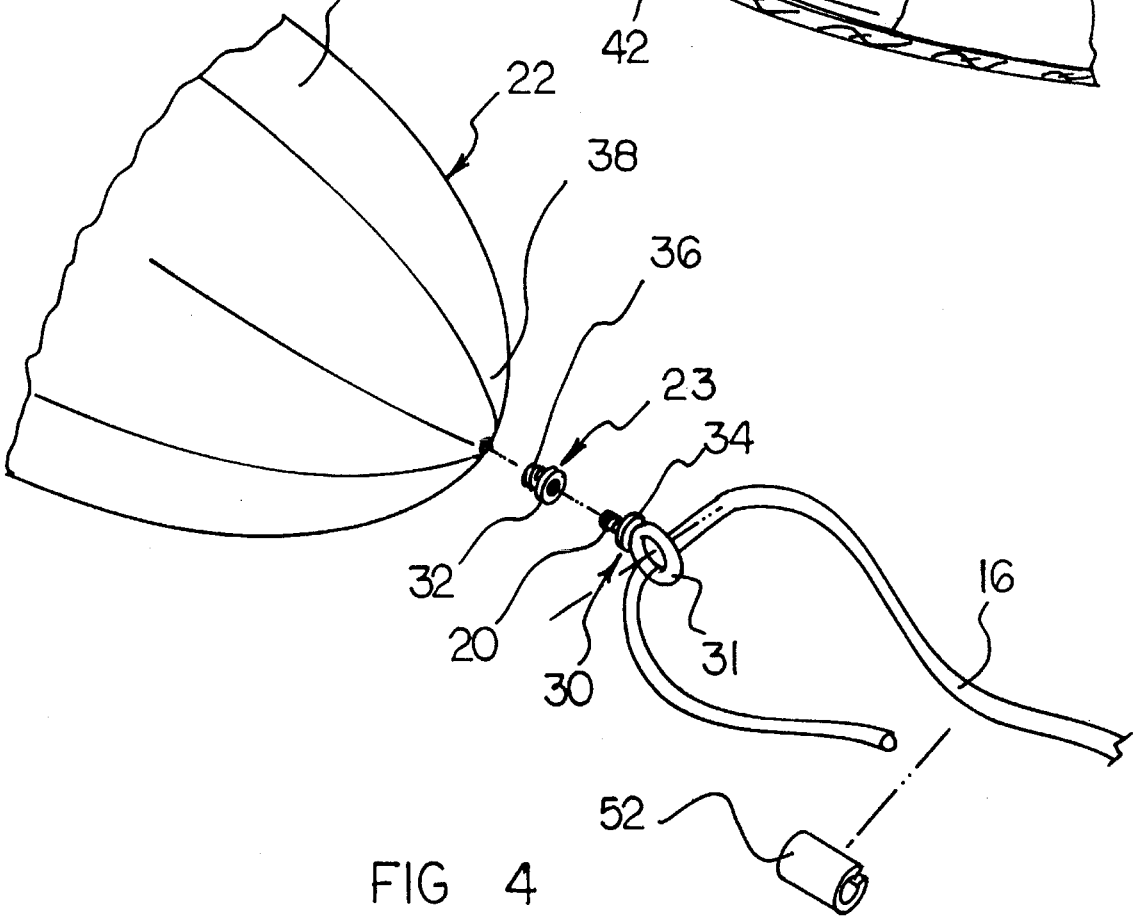
FIG. 4 is a partial exploded perspective view of the embodiment of the invention shown in FIG. 3.

Turning to FIGS. 1–4, there is shown a first embodiment of the tethered ball apparatus of the invention generally designated by reference numeral 10. In the first embodiment, tethered ball apparatus 10 includes an attachment assembly for attaching the tethered ball apparatus 10 to a rigid support. A swivel assembly is connected to the attachment assembly, and an elastic cord 16 is connected to the swivel assembly. A cord receiver includes an externally threaded screw portion 20, and the elastic cord 16 is connected to the cord receiver. A ball assembly 22 includes an internally threaded anchor embedded in a portion of the ball assembly 22, and the externally threaded screw portion 20 of the cord receiver is screwed into the internally threaded anchor.

In accordance with one embodiment of the invention, the attachment assembly includes a support-attaching screw eye 28. The support-attaching screw eye 28 is attached to a support post 26. The swivel assembly includes a swiveling strap eye bolt snap 15. The elastic cord 16 is comprised of bungee cord material. In one embodiment of the invention, an unstretched length of elastic cord can be 6 to 8 feet in length. When this elastic cord is stretched, the cord can stretch to a length from 10 to 12 feet.

The cord receiver includes a ball-attaching screw eye 30. The ball-attaching screw eye 30 includes an eye portion 31. An intermediate locking flange 34 is located adjacent to the eye portion 31, and a screw portion 20 projects from the intermediate locking flange 34. The internally threaded anchor in the ball assembly 22 is comprised of an internally threaded hollow cylindrical anchor 23. The internally threaded hollow cylindrical anchor 23 further includes external threads 36.

The ball assembly 22 may include a football which has two pointed ends 38. With a football, the internally threaded anchor is located in the football at one of the pointed ends 38. With a football, the ball assembly 22 includes an exterior jacket portion 40, and an inflated internal tube portion 42. The internally threaded anchor is secured into a pointed end 38 of the exterior jacket portion 40 of the ball assembly 22. The internally threaded hollow cylindrical anchor 23 includes an exterior locking flange 32.

In using the first embodiment of the tethered ball apparatus 10 of the invention, a rigid support post 26 is selected, and a support-attaching screw eye 28 is screwed into the support post 26. The swiveling strap eye bolt snap 15 is snapped onto the support-attaching screw eye 28. One free end of the elastic cord 16 is looped through the eye portion 50 of the swiveling strap eye bolt snap 15. The free end of the elastic cord 16 is secured to the remainder of the elastic cord 16 using a locking clip 52. The internally threaded hollow cylindrical anchor 23 has external threads 36, and the external threads 36 are screwed into one of the pointed ends 38 of the exterior jacket portion 40 of the football assembly 22. An adhesive may also be employed to secure the internally threaded hollow cylindrical anchor 23 to the exterior jacket portion 40 of the ball assembly 22. With the internally threaded hollow cylindrical anchor 23 installed in the exterior jacket portion 40, the internal tube portion 42 of the ball assembly 22 can be inflated in the usual manner. The screw portion 20 of the ball-attaching screw eye 30 is screwed into the internally threaded hollow cylindrical anchor 23.

To lock the ball-attaching screw eye 30 onto the internally threaded hollow cylindrical anchor 23, the intermediate locking flange 34 on the ball-attaching screw eye 30 is screwed up against the exterior locking flange 32 of the internally threaded hollow cylindrical anchor 23. The frictional contact between the exterior locking flange 32 and the intermediate locking flange 34 keeps the ball-attaching screw eye 30 secured to the internally threaded hollow cylindrical anchor 23. Then, the other free end of the elastic cord 16 is looped through the eye portion 31 of the ball-attaching screw eye 30. Then, the free end is secured to the remainder of the elastic cord 16 using a locking clip 52 which is squeezed around the free end and a portion of the remainder of the elastic cord 16. As any twist occurs in the elastic cord 16, the twist is relieved by relative rotation of portions of the swiveling strap eye bolt snap 15. With the elastic cord 16 attached to the football assembly 22. A solitary person can practice passing and receiving skills.

The ball assembly 22 can be easily separated from the tether by unscrewing the ball-attaching screw eye 30 from the internally threaded hollow cylindrical anchor 23. When the ball assembly 22 is separated from the elastic cord 16 and the ball-attaching screw eye 30, the ball assembly 22 can be used like a conventional, untethered ball. Moreover the swiveling strap eye bolt snap 15 can be easily separated from the support-attaching screw eye 28 by unsnapping the snap portion 56 from the support-attaching screw eye 28. The snap portion 56 includes a lock pin 58. A pin-urging spring 60, and a handle 62 for pulling back the lock pin 58 against the urging of the spring 60. By separating the tethered ball apparatus 10 from the support-attaching screw eye 28 and the support post 26, the tethered ball apparatus 10 is portable and can be carried virtually anywhere. The swiveling strap eye bolt snap 15 also includes a hook end 64 for hooking the support-attaching screw eye 28 and, as mentioned above, an eye portion 50 for receiving a free end of the elastic cord 16. The swiveling strap eye bolt snap 15 also includes a ball and socket assembly 66 which permits the swiveling action provided by the swiveling strap eye bolt snap 15.

Turning to FIGS. 5 and 6, a second embodiment of the invention is shown. Reference numerals are shown that correspond to like reference numerals that designate like elements shown in the other figures. In addition, the attachment assembly includes a strap assembly 44 which contains a quantity of a hook-containing fabric 46 and a quantity of a complementary loop-containing fabric 48. The hook-containing fabric 46 and the loop-containing fabric 48 can be made from well known VELCRO(TM) material.

In using the second embodiment of the tethered ball apparatus 10 of the invention, the strap assembly 44 is connected to a selected rigid support, such as support post 26. To do so, the strap assembly 44 is wrapped around the rigid support, and the hook-containing fabric 46 is connected to the loop-containing fabric 48 to secure the strap assembly 44 to the rigid support. To remove the tethered ball apparatus 10 of the invention from the rigid support, the hook-containing fabric 46 is detached from the loop-containing fabric 48, and the strap assembly 44 is unwound from the rigid support. When separated from the rigid support, the tethered ball apparatus 10 of the invention is portable and can be carried virtually anywhere.

The components of the tethered ball apparatus of the invention can be made from inexpensive and durable metal and plastic materials. The elastic cord can be made from commonly available elastic cords used in "bungee" devices.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved tethered ball apparatus that is low in cost, relatively simple in design and operation, and which may advantageously be used in such a way that an inflatable ball can be used with the tether. With the invention, a tethered ball apparatus is provided which employs an elastic tether. With the invention, a tethered ball apparatus is provided which has a means for attaching a ball to a tether without using a ball harness that has portions that fit into recesses of the ball. With the invention, a tethered ball apparatus is provided which does not have a protuberance protruding from the surface of a ball when a tether is detached from the ball. With the invention, a tethered ball apparatus provides a tethered ball that is not permanently connected to its tether. With the invention, a tethered ball apparatus is provided which includes a swivel located between an elastic tether and a rigid support. With the invention, a tethered ball apparatus provides an attachment means that is readily connected to and readily disconnected from a rigid support. With the invention, a tethered ball apparatus is provided which is readily portable and is readily carried to a variety of locations to which the tether can be attached.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by LETTERS PATENT of the United States is as follows:

1. A tethered ball apparatus, comprising:

an attachment assembly;

a swivel assembly connected to said attachment assembly;

an elastic cord connected to said swivel assembly;

a cord receiver which includes an externally threaded screw portion, the elastic cord being connected to the threaded screw portion;

a ball assembly including a football having two pointed ends, the football including an exterior jacket portion, an inflated internal tube portion within the exterior jacket portion, and an internally threaded hollow cylindrical anchor having external threads and an exterior locking flange, the external threads being threadably engaged directly to the exterior jacket portion of the football at one of said pointed ends;

wherein said externally threaded screw portion of said cord receiver is screwed into said internally threaded hollow cylindrical anchor.

* * * * *